United States Patent [19]

Filteau

[11] Patent Number: 4,905,439

[45] Date of Patent: Mar. 6, 1990

[54] STRUCTURAL BUILDING ELEMENTS

[75] Inventor: Jacques Filteau, Cobourg, Canada

[73] Assignee: Sparfil International, Inc., Ontario, Canada

[21] Appl. No.: 257,138

[22] Filed: Oct. 13, 1988

Related U.S. Application Data

[63] Continuation of Ser. No. 40,727, Apr. 17, 1987, abandoned, which is a continuation of Ser. No. 773,526, Sep. 6, 1985, abandoned, which is a continuation-in-part of Ser. No. 462,122, Jan. 28, 1983, abandoned.

[30] Foreign Application Priority Data

Apr. 13, 1983 [CA] Canada ..... 425788

[51] Int. Cl.[4] ..... E04C 2/10; C04B 7/02; C04B 16/08

[52] U.S. Cl. ..... 52/309.12; 52/405; 106/90; 521/55

[58] Field of Search ..... 52/309.12, 596; 106/90, 106/97; 521/81, 83, 55

[56] References Cited

U.S. PATENT DOCUMENTS

| | | | |
|---|---|---|---|
| 3,214,393 | 10/1965 | Sefton | 521/83 |
| 3,247,294 | 4/1966 | Sabouni | 52/309.12 |
| 3,257,338 | 6/1966 | Sefton | 521/83 |
| 3,869,295 | 3/1975 | Bowles | 521/83 |
| 3,899,455 | 8/1975 | Unterstenhofer | 521/83 |
| 4,040,855 | 8/1977 | Pentek | 106/97 |
| 4,148,166 | 4/1979 | Toone | 52/309.12 |
| 4,193,241 | 3/1980 | Jensen | 52/309.12 |
| 4,295,810 | 10/1981 | Dennert | 52/309.12 |

FOREIGN PATENT DOCUMENTS

| | | | |
|---|---|---|---|
| 2208659 | 9/1973 | Fed. Rep. of Germany | 52/309.12 |
| 2825508 | 12/1979 | Fed. Rep. of Germany | 52/405 |

OTHER PUBLICATIONS

Engineering Materials Handbook by McGraw-Hill Book Co., pp. 24–39.

Handbook of Heavy Construction by Stubbs, 1959, p. 9.26.

Materials of Construction by Mills et al., published by John Wiley & Sons, New York, published 1955, pp. 314–317.

Engineering Materials Handbook by McGraw-Hill Book Co., 1958, pp. 24–12 to 24–14.

*Primary Examiner*—John E. Murtagh

*Attorney, Agent, or Firm*—Browdy and Neimark

[57] ABSTRACT

This invention provides improved strength structural building elements having improved insulation properties. The element comprises a monolithic form with at least a pair of opposed faces and at least one aperture which extends between the opposed faces. In one embodiment, the building element is formed of a mixture of expanded cellular synthetic material, sand of a particular finus modulus to impart improved strength, and cementitious material with the cellular material being distributed throughout the structural element. In another embodiment, the building element is formed of expanded cellular material of three approximately equal particle size distribution ranges to provide expanded strength characteristics, sand and cementitious material. Both embodiments can be dry cast.

13 Claims, 1 Drawing Sheet

STRUCTURAL BUILDING ELEMENTS

This application is a continuation of application Ser. No. 040,727, filed Apr. 17, 1987, now abandoned itself a continuation of Ser. No. 773,326, filed Sept. 6, 1985, now abandoned itself a continuation-in-part of U.S. application Ser. No. 462,122 filed Jan. 28, 1983 now abandoned.

This invention relates to a structural building element, and to a method of manufacturing improved structural building elements.

Modified cementitious building elements are known in the art as, for example, disclosed in Canadian patent No. 1,093,729 of Jan. 13, 1981 and Canadian patent No. 1,094,111 of Jan. 20, 1981. Such building elements form construction blocks of varying sizes which are used in the fabrication of walls, partitions and the like of residential, industrial or commercial buildings. Typically, such building elements, also known as cinder blocks, are made of cement together with aggregates such as crushed stone and/or sand and molded into varying shapes and sizes according to the different types of building elements required in the art. Such modified building elements incorporate glass fiber reinforcement.

Another type of modified building element is shown in the art of light weight concrete products of, for example, U.S. Pat. No. 3,257,338, Sefton; U.S. Pat. No. 3,214,393, Sefton; Toone U.S. Pat. No. 4,148,166; Sabouin U.S. Pat. No. 3,247,294 and the like which utilize various types of cementitious mixtures incorporating expanded thermoplastic materials, and sometimes with a "filler" which may be asbestos, wood-fibers, slag, sand, jute or the like.

In general, the use of lightweight concrete building elements have several advantages over all-concrete building elements, ranging from transportation savings to greater ease of installation or building erection, etc. In addition, depending on the particular type of building element, improved insulation values are obtained.

The art is continually seeking improvements to the structural characteristics of lightweight building elements made of cementitious material and expanded synthetic material, not only as to insulation value, but also as to structural strength and characteristics. Also, the greater the insulation value, the more economical for heating and/or cooling buildings. Additionally, the requirements for structural load bearing capabilities are increasing so as to permit these lightweight concrete products to be used in different types of buildings.

In accordance with this invention, applicant has found that improved structural characteristics in terms of the strength of the products can be obtained; according to one development disclosed herein, structural building elements having improved strength characteristics may be obtained by providing a building element comprising a structural element of a monolithic form having at least a pair of opposed faces and at least one aperture extending between the opposed faces, the element being formed of a mixture of expanded cellular synthetic material, sand, cementitious material and any filler material if and as desired, the sand having a finus modulus of between about 2.2 to about 3.1, the cellular material being distributed throughout the element, and being comprised of small discrete particles, the cementitious material and the sand forming a matrix binding the expanded cellular material into the monolithic form.

More particularly, in accordance with this development, applicant has unexpectantly found that the finus modulus of sand, employed in a lightweight structural element, has certain limits above and below which the structural properties drop off significantly. In greater detail, and in explanation of this invention, the prior art has proposed that various types of fillers be included in light-weight building elements such as those mentioned above. One of the fillers proposed in such prior art disclosures includes generally sand but it has not been recognized in the lightweight building art, that the finus modulus of the sand, in conjunction with the expanded cellular synthetic material, should be within certain limits in order to obtain improved strength characteristics which are required for building elements.

It has been found, in accordance with this development, that when employing lightweight building mixtures of the above type, the compressive strengths will very significantly drop off or vary above a finus modulus above the ranges indicated and conversely, at below the ranges indicated, a significant loss of compressive strengths will occur, sometimes as much as 50 percent or more compared to similar blocks according to this development which have finus modulus characteristics within the range indicated above.

The significance of improved structural strengths of the products of the present invention will be evident from the fact that they will find wider application in the known areas of construction and at the same time, provide very beneficial results in terms of insulation characteristics, and the like.

In this development, it is therefore critical that the sand employed in the building elements have a finus modulus of between about 2.2 to about 3.1, and more preferably, between about 2.4 and 3.0. As used herein all calculations for the finus modulus of the sand are based on the sand component per se, excluding any silica fines or flours which may be added or included in other ingredients in a composition of the above type.

In the above compositions having sand with a finus modulus of 2.2 to 3.1, it is particularly preferred to use expanded cellular material that is comprised of small discrete particles, in amounts of 30 to 50% by volume, with a diameter of generally from about 0.5 to about 4 mm and most desirably, within the range of 0.5 to about 3 mm diameter. More particularly, it is preferred that the expanded cellular material have the particle size distribution as described hereinafter with respect to a further development. It has been found that this small diameter provides a maximum compressive strength in the cementitious matrix for a given density and percent by volume of the expanded material. In preferred forms, the building element includes expanded cellular material of a substantially generally uniform distribution of particle sizes.

In accordance with a further development disclosed herein, there is provided an improvement in a lightweight building element having improved strength properties formed of expanded cellular synthetic material and cementitious material and sand and in which the building element is a monolithic form having at least a pair of opposed faces and at least one aperture extending between the opposed faces; the improvement wherein the cellular synthetic material comprises from about 25% to about 33% by volume having a mean particle size of 1.25 mm. with a particle size distribution ranging from 1 to 1.55 mm; from about 30% to about 50% by volume having a mean particle size of 2 mm.

with a particle size distribution ranging from 1.6 to 2.4 mm; and from about 25% to about 33% by volume having a mean particle size of 2.7 with a particle size distribution ranging from 2.5 to 3.0 mm.

In accordance with preferred form of said other development, the lightweight construction block comprises from about 30 to about 80% by volume of expanded cellular synthetic material embedded throughout a matrix of a cementitious material and sand (and if desired a filler). The cellular synthetic material is preferably polystyrene beads of a substantially spherical shape; in all embodiments, the cellular block has a flow path of heated or cooled air increased by a plurality of apertures adapted to receive an insulative insert, staggered one relative to the the other, and extending vertically through the block thereby providing a greater thermal resistance due to a longer path from one side of the block to the other side of the block.

In this development, it has been found that a construction block having good structural strength and insulative value is obtained when tee particle sizes of the polystyrene beads range as discussed above. It has been found that if the beads had a uniform particle size throughout, that the void content of the block—i.e., the space between the beads—would be greater than, as in the case of the present development, where a specified range of particle sizes is provided. Thus, for instance, if expanded polystyrene beads were utilized in approximately equal quantities ranging from 1 to 3 mm—that is, $\frac{1}{3}$ of about 1 mm particle size, $\frac{1}{3}$ of about 2 mm particle size, and $\frac{1}{3}$ of about 3 mm particle size, the void content of the resultant construction block would decrease by a minimum of 10%, and the bead content would increase by a comparable amount. Thus, by increasing the bead content and thereby decreasing the more highly conductive cement matrix, greater insulative value is also achieved.

As discussed above, the particle sizes of the beads generally range from about 1 mm to about 3 mm. Preferably, the construction blocks are provided with about $\frac{1}{3}$ of the beads each of the particle sizes. Generally, the construction blocks of the present invention may have about 5% smaller and/or larger particle sizes than those discussed above. That is, the beads may comprise up to about 5% fines and up to about 5% having a particle size larger than those defined above. Typically, if 10% of the polystyrene beads had a particle size larger than 3 mm, this generally affects the structural strength of the block as too many large particles are present, and the structural strength is thereby weakened. Not only the structural strength, but also, the insulative value of the construction blocks would be affected by the presence of too many large particles due to the void content of the blocks, as discussed above.

On the other hand, if the construction block were provided with too many small particle size polystyrene beads, although this may not affect the structural strength characteristics of the block to any significant degree, the insulative strength of the block would be decreased. Thus, while the polystyrene beads may expand to 40 to 50%, it will be appreciated that the smaller size beads would have less air entrapped therein and correspondingly, if too many small particle size beads were present in the construction block, the insulative strength of the block would be decreased.

In both embodiments of the structural building elements of the present invention, the elements may be provided with insulating material in the aperture(s) between the faces, with the building element being of such a construction that the flow path of heated or cooled air passing through the element is increased, thereby providing a greater thermal resistance due to a longer path from one side to the other side of the building element.

The expanded cellular synthetic material comprises a lightweight, permanent, non-structural material around which the cementitious material and sand forms a structural skin. For economic reasons, and according to a preferred embodiment, the synthetic material preferably comprises polystyrene beads of an expanded type. Preferably, the percentage of expanded polystyrene beads can be varied from about 3 to about 80% by volume of the total volume of the structural element, depending on the desired insulation value required for any given structure. Typically, the percentage of expanded synthetic beads can be varied from 3 to 70% by volume, most desirably 40 to 70% by volume, in a preferred configuration.

The expanded polystyrene beads most desirably have a round shape as opposed to an irregular shape and most preferably, their shape is of a substantially spherical outline in order to develop the maximum compressive strength in the cementitious matrix surrounding them for any given density and percentage of expanded cellular beads.

As noted above, a further characteristic of the expanded cellular material is that it has a substantially closed cellular structure, to obtain the most advantageous features, it has been found that the closed cellular structure provides the products of the present invention with freeze-thaw resistance since moisture cannot get into the expanded cellular material, but only around the beads. It has been found that when water or moisture freezes, the expanded cellular material acts as small valves to relieve the pressure of repetitive freezing and thawing.

A further characteristic of the expanded cellular material is that it is lightweight in nature. More particularly, the expanded cellular material preferably has a density in the range of from about 0.5 to about 2 pounds per cubic foot, desirably $\frac{3}{4}$ to about 1.5 pounds per cubic foot. Within these ranges, a reduction of the weight of the building elements in the order of 40–60% compared to regular concrete building elements can be obtained.

The cementitious matrix is preferably comprised of a mixture of Portland cement and sand. Various types of Portland cement can be used such as those known in the trade as "Types 1, 2 or 3". The particular choice of which type of cement to be employed will depend on various factors known to those skilled in the art such as the quality of any sand, weather conditions during mixing and curing, etc.

The sand of the particular finus modulus employed in one embodiment of this invention with the Portland cement may be typically angular or washed sand. In both embodiments, it will also be appreciated by those skilled in the art that the sand should be free of impurities. The relative quantity of sand to Portland cement can be varied to achieve different densities and compressive strengths, as required.

The products of the present invention are formed by a dry casting technique; that is to say, in contradistinction to conventional wet casting techniques, the components of the building elements are mixed together using only sufficient water to achieve a homogeneous blend of the ingredients, and in which the water is sufficient only to provide full hydration of the cement without excess water being present as required in wet casting. After mixing, the mixture may subsequently be conveyed into a hopper and fed into a mold of the desired shape and dimensions, and instantaneously extruded from the mold, preferably with vibration, to form a unit which from then on will hold its dimensions. The resulting building element may then be steam cured to result in a substantially dimensionally stable building element. The applicant has found that by using the dry casting technique, stability within plus or minus a few mm can be obtained and in a relatively short period of time compared to wet casting. As compared to wet casting techniques using much higher water/cement ratios and including expanded cellular material with sand and cement, such conventional techniques typically employ sand in a finus modulus of about 4 or lighter.

Various chemical additives known to those skilled in this art can be used to facilitate mixing and to ensure consistency of the mix together with high quality properties for the Portland cement.

The Portland cement acts as a binder for the sand and also as a binder of the cementitious matrix surrounding the expanded polystyrene beads. As such, the cement should be well mixed with the expanded polystyrene beads prior to forming the same into the desired shape, as for example, in a mold.

As outlined previously, a feature of the present invention is that the structural elements have at least one aperture extending between the opposed faces. These apertures are preferably in the form of cores of a continuous nature to enable insulation material, such as polyurethane material, to be inserted into the building blocks and to extend preferably from one face to the other. In turn, this maximizes the thermal insulation of the building elements.

In a further preferred embodiment, the building elements preferably have two or more apertures extending therethrough, which apertures form offset cores to increase the path of the material forming the block from one side to the other side. This in turn maximizes the thermal resistance contribution of the material forming the block.

The insulation material to be inserted into the apertures of the block may be any suitable material conforming to the size of the apertures. Suitable insulation materials include, for example, rigid polyurethane material, expanded polystyrene in a rigid form, etc. As will be appreciated, the density of the polyurethane or polystyrene material may vary according to properties desired in the end product.

As mentioned above, the apertures provided in the building elements extend completely through the element, that is, from one face to the other opposed face. The size of the apertures may vary and typically, may have a width of from about ¼ inch to 3 inches or more, preferably 1 to 2 inches, and a length of from about 1 inch to about 6 or 8 inches, although these dimensions are not critical. Typically, the width of the apertures may constitute about 80% or so of the width of the building element. The apertures may be of any shape such as rectangular, oval, elongated, with elongated being preferred. The insulating inserts to be inserted into the apertures, extending from one face to the other face are usually of a one-piece integral construction dimensioned so as to fit snugly within the apertures of the building element.

The products of the present invention have many advantageous features over the prior art products. More particularly, it has been found that the products of the present invention have much improved strength characteristics compared to similar products having a finus modulus outside the range given above, particularly in products which are dry cast, and as well, provide excellent insulation value due to the fact that the trapped air in the expanded cellular material serves to increase many times, e.g., 5 to 10 times, the thermal resistance of the products of the present invention compared to regular concrete In fact, it has been found that the expanded cellular material itself serves primarily as a mold to trap air inside a cementitious skin and this trapped air, in the cementitious skin imparts the increased thermal resistance. This increased thermal resistance also increases the concrete's fire resistance by a factor of 1 or more times, typically 2 times, compared to that of regular concrete.

Further, the improved thermal lag properties of the products of the present invention can be attributed to the combination of the mass and thermal resistance due to the structure and materials forming the products. It has also been found that the products of the present invention have excellent heat storage properties for a lightweight material and moreover, the products of the present invention are lightweight in and of themselves which in turn reduces transportation costs, facilitates handling and the like.

The thermal stability properties of the products are also excellent due to the skin formed around the expanded cellular material which forms structural air cells that resist compressing, settling, shrinking and rotting. The products also possess excellent freeze-thaw resistance which in turn is due to the impermeability of the expanded cellular material.

In installation, the products of the present invention are easily cut and possess a high strength to weight ratio.

Having thus generally described the invention, reference will now be made to the accompanying drawings, illustrating preferred embodiments, and in which.

Figure 1:
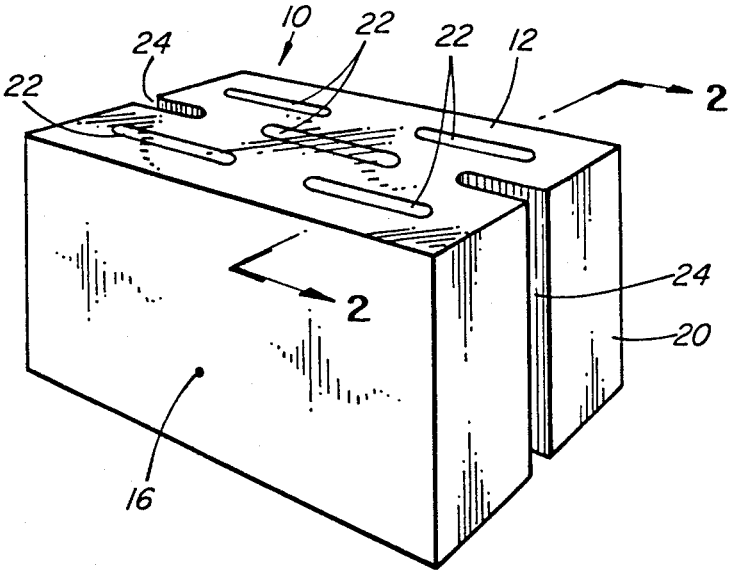
FIG. 1 is a perspective view of a structural building element of the present invention.

Referring in greater detail to the drawings, a typical building element is indicated generally by reference numeral 10 and as illustrated, in this embodiment, the building element comprises a pair of major faces 12 and 14 located in opposed relationship—the building element being of a substantially rectangular configuration. The faces 12 and 14 form the top and bottom of the structural element 10 with a pair of opposed side faces 16 and 18 and end faces 20.

Typically, the building element may have a size of from about 2 inches to about 10 inches or more in width, a height of from about 2 inches to about 10 inches or more, and a length of from about 4 inches to 20 inches or more such dimensions being as required by those skilled in the art for different building applications.

The building element in the embodiment illustrated is comprised of substantially spherical expanded polystyrene beads ranging in diameter from ½ to 3 mm with a particle size distribution described previously in a matrix of cementitious material which in this case, is a mixture of Portland cement and sand. Typically, the structural elements of FIGS. 1 and 2 may be formed by providing a mixture of polystyrene beads and Portland cement together with the sand having a finus modulus as described herein, i.e., between 2.2 and 3.1.

In a preferred form of production, the blocks as illustrated have been made by a dry cast method in which only a sufficient amount of water for hydration of the cement is provided; the homogeneous mixture is placed into a mold and immediately extruded as a block which can then be cured.

At least one aperture is provided extending between the opposed faces 12 and 14—in this case, five apertures 22 are provided which are of an elongated nature and as will be seen, are in a staggered relationship. In addition, apertures of approximately ½ the size are provided in each end wall 20, as indicated by reference numeral 24, which permit an insert (described hereinafter) to be placed between the apertures 24 of adjacent structural elements when mounted in an aligned manner.

Figure 2:
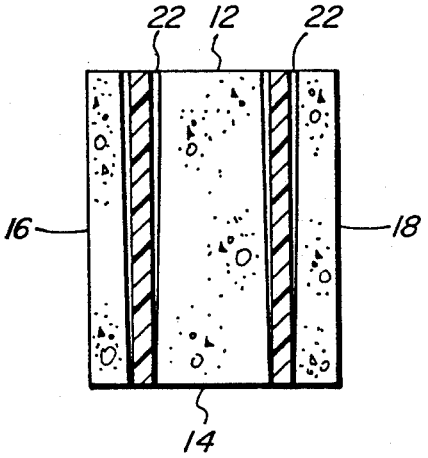
FIG. 2 is a section taken along the line 2—2 of FIG. 1.

In a preferred form, and as will be seen from the section of FIG. 2, the apertures 22 taper from one end to the other. Typically, these may taper from 0.5 mm to 3 mm or more and provide a converging/diverging vertically extending aperture between the opposed faces.

Figure 3:
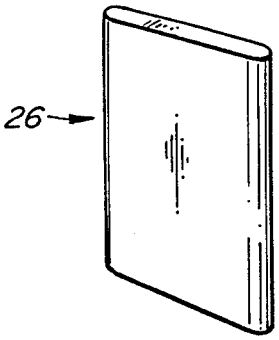
FIG. 3 is a perspective view of an insert for the structural element of FIG. 1.

In a preferred form of the present invention, there may also be employed core inserts indicated generally by reference numeral 26 (FIG. 3). In this embodiment, these inserts are preferably of a one-piece structure of suitable material of an insulating nature, such material typically being polyurethane, expanded polystyrene of a rigid nature, or the like. These inserts 26 are preferably dimensioned so as to fit into the apertures 22 as shown in FIG. 2 and accordingly, are of a generally elongated nature. The inserts 26 preferably extend flush with the faces 12 and 14 of the structural elements.

The above building elements as described and as shown in the drawings may be used to form walls for residential buildings or the like. Typically, a foundation of suitable material such as concrete is formed and the building elements aligned with each other in rows, preferably in a staggered relationship. The walls formed from the building elements may be dry-formed—that is, without mortar in between the building elements and after erecting a wall, the outer and inner surfaces (side walls) of the building elements may then be coated with an appropriate thickness of surface bonding cement. This technique of building walls has been found to be very expedient in building walls using the elements of the present invention.

EXAMPLE 1

A mixture for building blocks was prepared of Portland cement, sand and expanded polystyrene beads (the beads forming 60% of the mixture) in which the beads had particle sizes between 1 to 3 mm; the sand employed had a finus modulus of 3.0. The mixture was homogeneously blended with fines (e.g., silica flour) in an amount sufficient to provide a coating, together with the Portland cement, around the polyethylene beads.

The above mixture was dry cast molded and instantly extruded into blocks of 8"×16"×10" by providing the minimum required amount of water to mix the beads, sand and cement together; the resulting blocks were subsequently steam cured and found to have good dimensional stability within 4 mm. of the final dimensions desired for the block. The blocks, when cast, were formed with apertures, as illustrated in the drawings.

Replicate samples of such building elements had weight ranges of 14.1 kg; 13.6 kg and 14.1 kg for an average weight of 13.9. These elements, composed of the above mixture utilizing a sand having a finus modulus of 3.0, were then tested using ASTM-C-140-75(1980) for compressive strength on a gross area. The tests results yielded values of 2.85; 2.85; and 2.76 MPa, respectively, for the three samples providing an average of 2.82 MPa.

EXAMPLE 2

Building elements of the same dimensions, the same composition and structure as that described in Example 1 were prepared but in this case, sand with a finus modulus of approximately 2.6 was utilized. Replicate samples of such building blocks were cast using a dry cast method; compressive strength results (using the above ASTM method) of gross area for each replicate measured 2.80; 2.86 and 2.16 MPa for an average of 2.61 MPa per block.

EXAMPLE 3

Comparison building block samples were prepared, again using the same composition, structure and production techniques as those described in Examples 1 and 2, but in this case, the sand employed had a finus modulus of approximately 4.1. Replicate samples weighing 12.7, 13.2 and 12.8 kg were prepared and tested for compressive strength on gross area (using the above ASTM method) yielding results of 1.78; 1.94 and 1.46 MPa for an average of 1.73 MPa

EXAMPLE 4

The procedures described above with respect to Example 1 were repeated, but in this case, using sand with a finus modulus of approximately 1.8. Replicate samples were prepared, weighing 12.0; 12.1 and 11.6 kg. The dry cast cured products were then tested for compressive strength on gross area (using the above ASTM method) and measured 0.6; 0.5 and 0.7 MPa for a mean of 0.6 MPa.

As will be seen, when sand of a finus modulus over or below that employed in the compositions of the present invention is employed, the compressive strength characteristics of the resulting products very significantly drops off. In fact, the products of Examples 1 and 2 compared to those of Example 4 possessed more than 4 times the average strength characteristics of that of Example 4 even though the compositions were substantially identical except for the sand with the different finus modulus. Likewise, sand with a higher finus modulus, namely 4.1 is used in Example 3, resulted in products compared to the products of the present invention, which had 40% or less of the compressive strength characteristics of the present invention.

EXAMPLE 5

Five samples of construction blocks according to the teachings of the present invention were prepared for compression testing. Such blocks comprised a mixture of Portland cement, sand and filler material and expanded polystyrene beads. The ratio of polystyrene beads to matrix material constituted approximately 60% beads to 40% matrix material, by volume. The sand preferably has a finus modulus of between 2.2 and 3.1.

The polystyrene beads ranged in size from 1 to 3 mm in accordance with the particle size distribution of the present invention, and contained no more than 5% of a particle size greater and/or smaller than the largest and smallest particle sizes disclosed herein. The beads were provided in amounts of approximately ⅓ of each mean particle size as disclosed herein. The blocks were formed by a dry casting technique, which involved, briefly, the mixture of ingredients being homogeneously blended and only sufficient water added to provide full hydration of the cement and to provide a coating around the polystyrene beads. This mixture was placed into a mold and instantaneously extruded from the mold, with vibration. Thereafter, the dimensionally stable building blocks were steam cured.

In this example, the blocks were 190 mm (8"×8"×16") in size and ranged in weight from 10.8 kg to 11.00 kg with a mean of 10.995 kg. Compression tests according to ASTM C-140-75 (1980) carried out on these blocks yielded a failure load ranging from 144 to 165 kilonewtons, with a mean of 155.3 kilonewtons.

In a comparison test, samples of 190 mm blocks which included greater than 10% beads having a particle size larger than the largest range of the present invention, the mean weight of 10 samples being 10.8 kg, the mean failure load was of 138.19 kilonewtons.

From this example, it can be seen that by maintaining all other ingredients and procedures constant, only a minor variance of over 10% in one range of particle size distribution outside the range of this invention results in inferior compression strengths.

EXAMPLE 6

Five samples of construction blocks according to the teachings of the present invention were prepared for compression testing in accordance with the procedure in Example 5. The blocks comprised a mixture basically as described above with respect to Example 5. In this case, the blocks were 240 mm (10"×8"×16") in size and ranged in weight from 13.1 kg to 13.5 with a mean of 13.350 kg. Compression tests according to ASTM C-140-75 (1980) carried out on these blocks yielded a failure load ranging from 147 to 218.7 kilonewtons, with a mean of 193.7 kilonewtons.

In a comparison test, samples of 240 mm blocks which included greater than 10% beads having a particle size larger than the largest range of the present invention, the mean weight of 10 samples being 12.7 kg, the mean failure load of was 158.5 kilonewtons.

It will be understood that various modifications can be made to the above described embodiments, without departing from the spirit and the scope of the invention as defined herein.

I claim:

1. In a structural building element having improved strength characteristic formed of cementitious material, sand, cellular synthetic material and filler material, the improvement comprising a structural element of a monolithic form having at least a pair of opposed faces and at least one aperture extending between said opposed faces, said cellular material being distributed throughout said element, and being composed of small discrete particles in which there are a plurality of particle size distribution ranges, each particle size distribution range differing from the other so a to provide a range of particle sizes wherein the synthetic cellular material comprises from about 25% to about 33% by volume having a means particle size of 1.25 mm with a particle size distribution ranging from 1 to 1.5 mm; from about 30% by volume by about 50% having a mean particle size of 2 mm and a particle size distribution from 1.6 to 2.4 mm; and from about 25% to about 33% by volume having a mean particle size of 2.7 with a particle size distribution ranging from 2.5 to 3 mm; said cementitious material and said sand forming a matrix binding said expanded cellular material into said monolithic form.

2. The structural building element of claim 1, wherein said sand has a finus modulus of between about 2.2 and 3.1.

3. The structural building element of claim 1, wherein said sand has a finus modulus of between about 2.2 and 3.1, said cementitious material and said sand forming a matrix binding said expanded cellular material into said monolithic form.

4. The structural building element of claim 1, wherein said expanded cellular material comprises expanded beads of thermoplastic material of a closed cell structure.

5. The structural building element of claim 1, wherein said building element is a dry cast building element.

6. The structural building element of claim 1, wherein said cellular material comprises expanded polystyrene beads.

7. The structural building element of claim 1, wherein said aperture of said building element tapers from one face to the other face.

8. The structural building element of claim 1, wherein said element includes an insulative insert placed in said aperture between said opposed faces.

9. The structural building element of claim 1, wherein said sand has a finus modulus of between about 2.4 and 3.0.

10. The structural building element of claim 1, wherein said cellular synthetic material includes up to 5% by volume of fines having a particle size smaller than the smallest particle size of said cellular synthetic material and up to 5% by volume of material having a particle size greater than 3.0 mm.

11. The building element as defined in claim 1 wherein said cellular synthetic material includes up to 5% fines having a particle size smaller than the smallest particle size of said cellular synthetic material.

12. The structural building element of claim 1, wherein the weight of said expanded cellular material has a density of between about 0.5 pounds to about 2 pounds per cubic foot.

13. The building element of claim 1, comprising from about 30 to about 80% by volume of said expanded cellular synthetic material embedded throughout a matrix of a cementitious material and sand, said cellular synthetic material being of a substantially spherical shape; said construction block having a flow path of heated or cooled air increased by a plurality of apertures adapted to receive an insulative insert, staggered one relative to the other, and extending vertically through said block thereby providing a greater thermal resistance due to a longer path from one side of the block to the other side of the block.

* * * * *